United States Patent [19]

Dorius

[11] 4,372,195

[45] Feb. 8, 1983

[54] MASS FLOW THERMAL COMPENSATOR

[76] Inventor: John Dorius, 8601 International Ave., Unit 203, Canoga Park, Calif. 91304

[21] Appl. No.: 207,164

[22] Filed: Nov. 17, 1980

[51] Int. Cl.[3] ..... F24C 15/20

[52] U.S. Cl. ..... 98/115 R; 55/DIG. 36; 98/115 LH; 126/299 D

[58] Field of Search ..... 126/299 R, 299 D, 299 F; 98/115 R, 115 LH; 55/DIG. 18, DIG. 36; 73/861.01, 196; 137/468, 487.5

[56] References Cited

U.S. PATENT DOCUMENTS

| | | | |
|---|---|---|---|
| 2,668,697 | 2/1954 | Sager | 137/468 X |
| 3,411,428 | 11/1968 | Ahlrich | 126/299 D |
| 3,645,194 | 2/1972 | Ahlrich | 126/299 D |
| 3,664,255 | 5/1972 | Kuechler | 126/299 D |
| 3,890,887 | 6/1975 | Kaufman et al. | 126/299 D |
| 3,958,552 | 5/1976 | Lawler | 126/247 |
| 3,977,387 | 8/1976 | Lawler | 126/214 |
| 4,117,833 | 10/1978 | Mueller | 126/299 D |
| 4,146,017 | 3/1979 | Overton, Jr. | 126/299 D |
| 4,155,289 | 5/1979 | Garriss | 98/115 LH |

*Primary Examiner*—Albert J. Makay
*Assistant Examiner*—Harold Joyce
*Attorney, Agent, or Firm*—Nilsson, Robbins, Dalgarn, Berliner, Carson & Wurst

[57] ABSTRACT

A method and apparatus for balancing the inlet air flow against the exhaust air flow in a system for exhausting contaminant-laden air from a work space. The volume of inlet air is controlled in accordance with its temperature so that the weight rate of air through the inlet fan is set at a value approximating the actual or a selected average value of the weight rate of air per minute exhausted by the exhaust fan.

12 Claims, 2 Drawing Figures

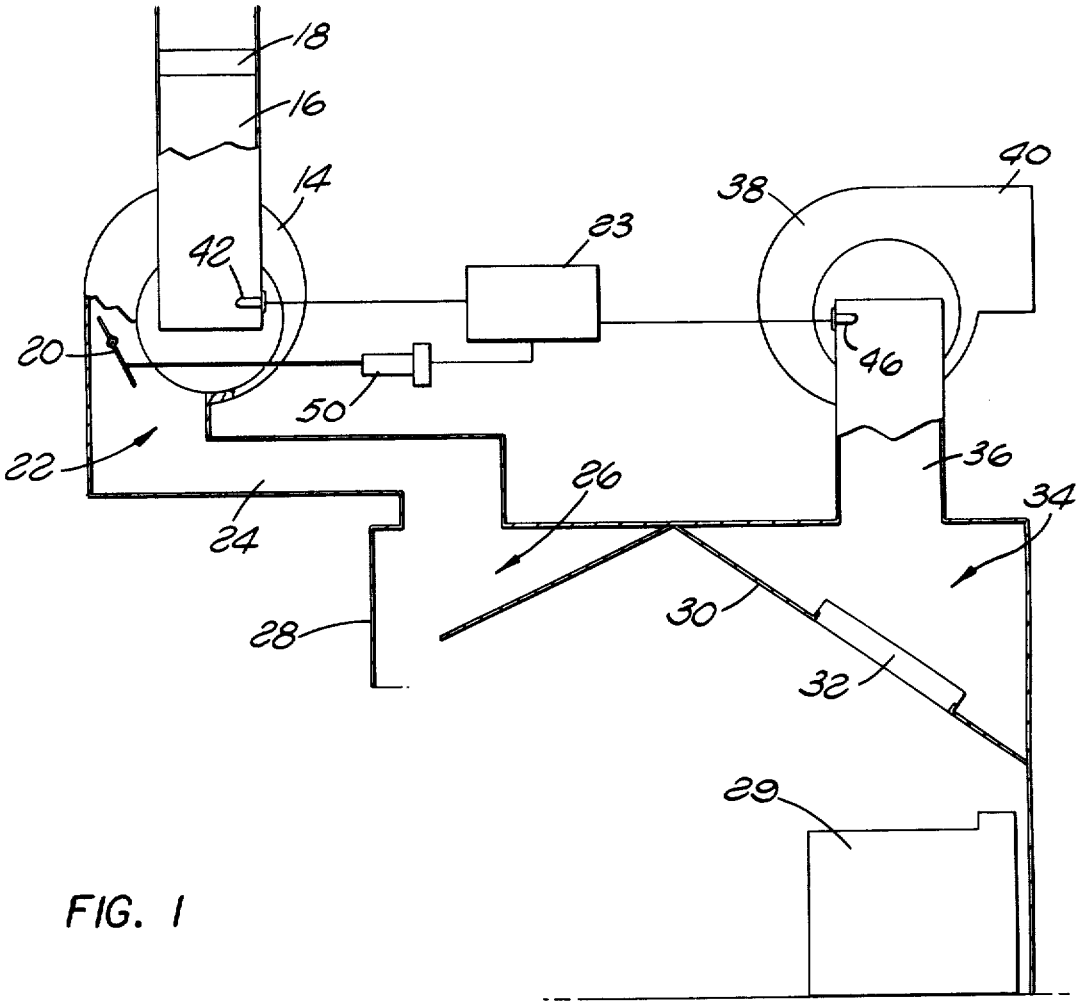
FIG. 1
FIG. 2
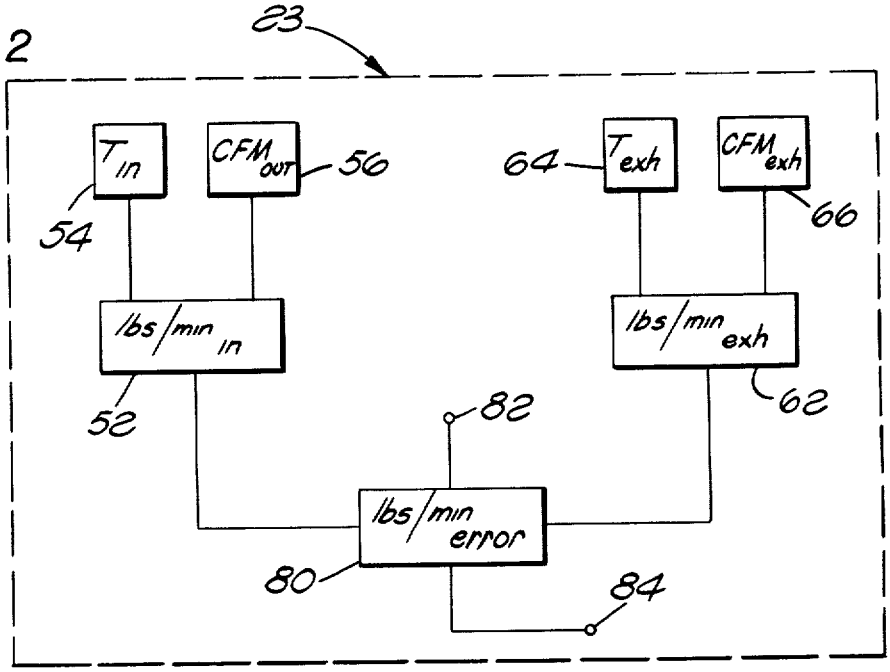

MASS FLOW THERMAL COMPENSATOR

FIELD OF THE INVENTION

The field of art to which the invention pertains is the field of ventilation hoods.

BACKGROUND AND SUMMARY OF THE INVENTION

When exhausting and replacing air from work spaces such as the cooking areas of commercial kitchens, large quantities of air are required to exhaust contaminants such as smoke, fumes, odors, vapors, and the like. With dwindling energy supplies it has become crucial to balance the amount of fresh air introduced into the work space with the amount of air exhaust from the work space. Usually the air in the work space is conditioned, i.e., heated or cooled as necessary to maintain it at a desired temperature and/or it is humidified or dehumidified as desired. Presently systems are used which incorporate a hood over the area in the workspace where the contaminants are principally generated, for example, from cooking in a restaurant. Fresh air is brought in with an air fan from a source external to the workspace and forced in under the hood. An exhaust fan draws a suction under the hood and removes contaminated air from under the hood. If the amount of inlet air exceeds the exhaust, the hood will be ineffective in removing contaminants. Accordingly, the amount of exhaust air should slightly exceed the inlet air to provide a satisfactory draw. However, excessive draw of exhaust air will unnecessarily waste conditioned air with resultant waste of energy.

Typical systems in current use attempt to balance inlet and exhaust on a volume basis. However, variations in the temperature and humidity of both the inlet air and exhaust air affect the state of balance between the amount of inlet and exhaust air. For example, an exhaust fan that draws air from under the hood over a commercial cooking station at a rate of 5,000 cubic feet per minute (CFM) and at a temperature of 120° F., is removing 342.21 pounds of air per minute. Assuming that the inlet air is dry, and is at a temperature of 100° F., the inlet air fan will have to supply only 4,827.2 CFM to balance the 342.21 pounds per minute of air being exhausted. However, if the temperature of the source of fresh air is 5° F., the inlet fan, running at a rate sufficient to supply the 4,827.2 CFM at 100° F., would supply 412.4 pounds per minute of air, exceeding the 342.21 pounds per minute being exhausted and pushing contaminants back into the kitchen. In order to remove all of the 412.4 pounds per minute at the exhaust temperature of 120° F., the exhaust fan would have to remove 6,025.6 CFM of air from under the hood.

In one method of attempting to overcome the effects of temperature differential, the inlet air is heated to match the exhaust temperature. This is, however, an energy wasting solution, since most of the inlet air is then immediately exhausted, and what is not exhausted is at a higher temperature than the conditioned air in the workspace. Multiple inlet and/or exhaust fans and/or fans having a plurality of discrete motor speeds, and, therefore, multiple discrete CFM outputs, have been used. However, the increments of adjustment are too coarse and the system too unwieldy for effectively balancing. This solution also necessitates a very complex control system and an energy wasteful cycling on and off of the fans. The prior art systems have thus attempted to solve the problem by treating the symptoms rather than the cause of the unbalance, i.e., an unbalance between the weight rate of air, i.e., the pounds of air per minute, exhausted and the weight rate of inlet air.

The present invention relates to a method and apparatus for balancing the inlet air flow of a hood against the exhaust air flow effectively on a weight basis. More particularly, the volume rate of the inlet air is metered or adjusted in accordance with its temperature to match the actual or an assumed selected average weight rate of the air being exhausted. Preferably, in order to assure that all contaminant-laden air is exhausted from the work space, the weight rate of the inlet air is controlled so as to be slightly less than the weight rate of the contaminant-laden exhaust air. This will assure that air from the adjacent room will be drawn into the hood to supplement the inlet air, thereby assuring no bleed-back of contaminants.

BRIEF DESCRIPTION OF THE DRAWING

FIG. 1 shows a schematic view of a hood system according to the present invention; and FIG. 2 shows a schematic view of the controller according to the present invention.

DETAILED DESCRIPTION

Referring to FIG. 1 a schematic view of the control system according to the present invention is shown for balancing the weight rate of inlet and exhuast air flows. The system includes an inlet air fan 14, which can be a centrifugal fan having an inlet duct 16 in fluid communication with an external source of fresh air through a filter 18. A spoiler 20 is positioned in the discharge end 22 of the inlet fan 14 for modifying its volume discharge in response to a control signal from an electronic controller 23. The position of the spoiler 20 as governed by the controller 23 determines the extent to which a portion of the discharge from the centrifugal fan vanes (not shown) is redirected back into the vanes. The spoiler 20 is used for this purpose because it is energy-efficient and simple, but it will be understood that other means of changing the volume of inlet air could be used, e.g., regulating the motor speed in response to a signal from the controller 23.

Discharge 22 from the inlet air fan 14 flows through a duct 24 to an inlet plenum 26 in a conventional exhaust hood 28. The exhaust hood 28 is positioned over a source of contaminants, e.g., a stove 29 and has an exhaust outlet cover 30 with a filter 32 providing fluid communication between the area under the hood 28 and an exhaust plenum 34, which is in fluid communication with the draw inlet 36 of an exhaust fan 38 having a discharge end 40 disposed externally of the work space.

Volume is controlled in accordance with the temperature differential of the inlet and exhaust air streams. A temperature detector 42 is positioned in the inlet duct 16 of the inlet air fan 14. Also, a temperature detector 46 is positioned in the draw inlet 36 of the exhaust fan 38. Signals representative of the respective temperatures are supplied by the detectors 42 and 46 to the controller 23, and, as more fully described below, the controller 23 generates a control signal for modifying the volume discharge of the inlet air fan 14. More specifically, the control signal operates an hydraulic positioner 50 which controls the position of the spoiler 20 in the discharge end 22 of the inlet air fan 14. The spoiler 20 is spring-biased to the closed position; and the controller 23 provides a signal which regulates the pressure on one side of a hydraulic piston in the positioner 50, which thereby regulates the amount the spoiler is moved toward the fully-open position against spring pressure.

Referring to FIG. 2, a preferred embodiment of the controller 23 is shown. The controller 23 has a "pounds per minute" weight rate inlet ($lbs/min_{in}$) computer 52 which has input signals from a $temperature_{in}$ ($T_{in}$) signal generator 54, connected to the temperature sensor 42 in the inlet duct 16 of the inlet air fan 14, and also a feedback signal generator 56 indicating the volume rate, i.e., $CFM_{in}$ of the inlet fan 14, based upon the position of the spoiler 20 or on the output signal of the controller 23 to the hydraulic positioner 50. The output signal from the $lbs/min_{in}$ computer 52, representative of the computed weight rate of inlet air, is connected to a $lbs/min_{error}$ comparator 80.

A "pounds per minute" weight rate exhaust ($lbs/min_{exh}$) computer 62 in the controller 23 as an input signal from an exhaust temperature ($T_{exh}$) signal generator 64, connected to the temperature sensor 46 in the draw inlet 36 of the exhaust fan 38, and is representative of the temperature of the contaminant-laden exhaust air passing through the exhaust fan 38. The $lbs/min_{exh}$ computer 62 also has an input representative of the volume rate of air through the exhaust fan 38, which preferably is a selected constant based upon the speed of the exhaust fan 38. The output signal from the $lbs/min_{exh}$ computer 62, representative of the computed weight rate of the exhaust, is connected to the lbs/min error comparator 80.

The pounds per minute error ($lb/min_{error}$) comparator 80 compares the output signal from the $lbs/min_{in}$ computer 52 and the output signal of the $lbs/min_{exh}$ computer 62. The output signal of the $lbs/min_{exh}$ computer 62 has added to it a signal on output 82 to the $lbs/min_{error}$ comparator 80 representative of the desired excess of "$lbs/min_{exh}$" over "$lbs/min_{in}$", in order to have the weight rate of discharge by the inlet fan 14 into the work space be slightly less than the weight rate of discharge by the exhaust fan 38, so that exhaust of all contaminant-laden air is assured. The signal on input 82 can represent, e.g., 5 lb/min or a percentage, e.g., 1% of either the $lbs/min_{in}$ or $lbs/min_{exh}$.

An example of a suitable controller 23 is a Barber-Colman Controls Model CP 8102 which can be set up by one skilled in the art to generate an error signal based upon the inputs of $T_{in}$, $CFM_{in}$, $T_{exh}$ and $CFM_{exh}$ and the desired excess of $lbs/min_{exh}$ over $lbs/min_{in}$. An example of a suitable positioner 50 is a Barber-Colman Controls Model MP 5220 which has a variable force hydraulic piston having a shaft connectable to the spoiler 20. The pressure on the hydraulic piston and thus the force on the spoiler 20, varies with the error signal and thus positions the spoiler 20 against spring pressure to a desired position dependent upon the error signal. The temperature sensors 42 and 46 may be, for example, Barber-Colman Controls Model TS 8201 temperature sensors.

In operation, the $lb/min_{error}$ comparator, calculates the difference between $lb/min_{in}$ and $lb/min_{exh}$ and the constant signal on input 82 representing the desired excess of $lb/min_{exh}$ over $lb/min_{in}$. An error signal is generated by the $lb/min_{error}$ computer 80 on output 84 which is connected to the hydraulic positioner 50 to regulate the pressure on a hydraulic piston within the positioner 50, which controls the amount of force applied to the spoiler 20 by the positioner 50 to position the spoiler 20 against spring bias towards the closed position. The volume rate of the inlet fan 14 will thus be controlled so as to balance the $lb/min_{in}$ with the $lb/min_{exh}$, subject to the selected excess $lb/min_{exh}$ from the input 84 signal.

The present invention relies for its effectiveness on the correlation of decreasing density of air to temperature. TABLE I shows the values for CF/lb of dry air as a function of temperature and the density factor based upon a standard value of 1.000 at 70° F. Knowing the temperature and the volume rate of the inlet fan 14, the $lbs/min_{in}$ can be calculated, assuming dry air, based upon the relationship indicated by TABLE I. The CF/lb of dry air varies linearly above −20° F. up to at least 130° F., an acceptable operating range. If it is desired to have a capability of operation below −20° F. of inlet air, since non-linearity below that point, down to −40° F. is not very significant, the relationship can be assumed to be linear between −20° F. and −40° F.

TABLE I

| Temp °F. | CF/lb Dry Air | Density Factor | Temp °F. | CF/lb Dry Air | Density Factor | Temp °F. | CF/lb Dry Air | Density Factor |
|---|---|---|---|---|---|---|---|---|
| −40 | 10.566 | 1.2633 | 15 | 11.958 | 1.1162 | 70 | 13.348 | 1.000 |
| −35 | 10.690 | 1.2486 | 20 | 12.084 | 1.1046 | 75 | 13.474 | .9906 |
| −30 | 10.820 | 1.2336 | 25 | 12.211 | 1.0931 | 80 | 13.601 | .9814 |
| −25 | 10.950 | 1.2190 | 30 | 12.338 | 1.0818 | 85 | 13.727 | .9724 |
| −20 | 11.073 | 1.2055 | 35 | 12.464 | 1.0709 | 90 | 13.853 | .9635 |
| −15 | 11.200 | 1.1918 | 40 | 12.590 | 1.0602 | 95 | 13.980 | .9547 |
| −10 | 11.326 | 1.1785 | 45 | 12.717 | 1.0496 | 100 | 14.106 | .9462 |
| −5 | 11.452 | 1.1656 | 50 | 12.843 | 1.0393 | 105 | 14.232 | .9379 |
| 0 | 11.578 | 1.1529 | 55 | 12.970 | 1.0291 | 110 | 14.359 | .9296 |
| 5 | 11.705 | 1.1404 | 60 | 13.096 | 1.0194 | 115 | 14.458 | .9215 |
| 10 | 11.831 | 1.1282 | 65 | 13.222 | 1.0095 | 120 | 14.611 | .9136 |
| | | | | | | 125 | 14.738 | .9057 |
| | | | | | | 130 | 14.864 | .8980 |

ADVANTAGES OF THE INVENTION

It will be understood that in constructing or carrying out an apparatus and method for balancing inlet and exhaust air flows in a system for exhausting contaminant-laden air from a work space, according to the present invention, certain significant advantages are obtained.

For example, regulation of the volume rate of the inlet air so as to maintain a fixed relationship between $lbs/min_{in}$ and $lbs/min_{exh}$, i.e., with $lbs/min_{in}$ slightly less than $lbs/min_{exh}$, an optimum balance is achieved so that energy need not be wasted in conditioning relatively large amounts of excess inlet air or in making up for conditioned air exhausted if there is a relatively large excess of exhaust air over inlet air. The problems of the prior art, which attempted to balance the volume ratio of inlet and exhaust by either heating of the inlet air to match the exhaust air temperature or varying the number and/or speed of the inlet and/or exhaust fans, have been eliminated. There is no need in the method and apparatus of the present invention for the energy wasteful practice of heating the inlet air or the energy wasteful practice of shifting the speed and/or combination of control fans.

The control system of the present invention can be very simple; it need only sense the inlet air temperature to function satisfactorily and may optionally also sense the exhaust air temperature for finer control when the exhaust air temperature varies over a wide range. The control system is inexpensive, requires little added equipment to the usual inlet-exhaust fan system, and gives a much better balancing effect than prior art systems.

The foregoing description of the present invention has been directed to a particular preferred embodiment for purposes of illustration. It will be apparent, however, to those of ordinary skill in the art, that many modifications and changes in both the apparatus and method of the present invention may be made without departing from the scope and spirit of the invention. For example, as above indicated, it is not always necessary to sense the exhaust air temperature and/or the exhaust CFM. In certain applications, the exhaust air temperature will not significantly vary about an average exhaust temperature. The controller can thus conveniently be set to compare the $lbs/min_{in}$ dependent upon $T_{in}$ and $CFM_{in}$ with a constant representative of the $lbs/min_{exh}$ at the assumed average $T_{exh}$ and at the constant $CFM_{exh}$. In some applications, it may also be desirable to take the humidity of the inlet and outlet air into account in determining the $lbs/min_{in}$ and $lbs/min_{exh}$. Humidity detectors in the inlet and exhaust air flow passages can be employed to detect the respective humidities and a slightly more complicated controller used to calculate the error signal representative of the out of balance in $lbs/min_{in}$ and $lbs/min_{exh}$, as those values are determined, taking into account humidity as well as temperature of the inlet and/or exhaust air.

These and other modifications of the invention will be apparent to those skilled in the art. It is Applicant's intention in the following claims to cover all such equivalent modifications and variations as fall within the true spirit and scope of the invention.

What is claimed is:

1. In an apparatus for balancing inlet air flow against exhaust air flow in a system for exhausting air from a work space, the apparatus containing an inlet fan including a spoiler, in fluid communication with a source of fresh air and discharging into the workspace to define an inlet air passage, and an exhaust fan in fluid communication with the workspace and discharging externally of the workspace to define an exhaust air passage, the improvement comprising:

an inlet air temperature sensor in the inlet air passage; and control means for controlling the weight rate of air through the inlet fan in response to the temperature sensed by the inlet air temperature sensor, comprising means for regulating the position of the spoiler to maintain a selected relationship between the weight rate of inlet air and an actual or assumed weight rate value of exhausted air.

2. In an apparatus for balancing inlet air flow against exhaust air flow in a system for exhausting air from a work space, the apparatus containing an inlet fan in fluid communication with a source of fresh air and discharging into the workspace to define an inlet air passage, and an exhaust fan in fluid communication with the workspace and discharging externally of the workspace to define an exhaust air passage, the improvement comprising:

an inlet air temperature sensor in the inlet air passage; and control means for controlling the weight rate of air through the inlet fan in response to the temperature sensed by the inlet air temperature sensor, comprising:

means for generating a weight rate inlet air signal, means for generating a weight rate exhaust air signal, means for generating a control signal representing the difference between said weight rate inlet air signal and said weight rate exhaust air signal, and means for regulating the volume of air through the inlet fan in response to said control signal.

3. The improvement of claim 2 in which said means for generating a weight rate inlet air signal comprises:

means for generating a signal representing the volume rate of air through said inlet fan;

means for generating a signal representing the temperature of the air through said inlet fan; and means for calculating the weight rate of inlet air from said inlet air volume and temperature signals.

4. The improvement of claim 2 in which said means for generating a weight rate exhaust air signal comprises:

means for generating a signal representing the volume rate of air through said exhaust fan;

means for generating a signal representing the temperature of the air through said exhaust fan; and means for calculating the weight rate of exhaust air from said exhaust air volume and temperature signals.

5. The apparatus of claim 2 including means for adding a signal representating desired excess of exhaust air over inlet air to the signal representing the weight rate of exhaust air.

6. The apparatus of claim 2 wherein the signal representing the exhaust air temperature is a preselected constant, and the volume rate of air exhausted by the exhaust fan is set at a preselected constant value.

7. A method for balancing the inlet and exhaust air flows in a system for exhausting air from a work space comprising:

controlling the volume rate inlet air in response to the temperature of the inlet air so that the weight rate of inlet air is maintained at a selected fixed relationship to the weight rate of exhaust air, said weight rate of exhaust air being an assumed value or a determined value based upon sensed exhaust air temperature, said inlet air being provided by an inlet air fan containing a spoiler, the volume of inlet air being controlled by regulating the position of the spoiler to maintain a selected relationship between the weight rate of said inlet air and said assumed or determined value of exhausted air.

8. A method for balancing the inlet and exhaust air flows in a system for exhausting air from a work space comprising:

controlling the volume rate inlet air in response to the temperature of the inlet air so that the weight rate of inlet air is maintained at a selected fixed relationship to the weight rate of exhaust air, said weight rate of exhaust air being an assumed value or a determined value based upon sensed exhaust air temperature, said inlet air being provided by an inlet air fan and said exhaust air being exhausted by an exhaust fan, the inlet air volume being controlled by the steps of:

generating a signal representing the weight rate of inlet air through said inlet air fan, generating a signal representing the weight rate of exhaust air through said exhaust fan, generating a control signal representing the difference between said weight rate inlet air signal and said weight rate exhaust air signal, and regulating the volume of air through the inlet fan in response to said control signal.

9. The method of claim 8 in which said weight rate inlet air signal is generated by the steps comprising:

generating a signal representing the volume rate of air through said inlet fan;

generating a signal representing the temperature of the air through said inlet fan; and calculating the weight rate of inlet air from said inlet air volume and temperature signals.

10. The method of claim 8 in which said weight rate exhaust air signal is generated by the steps comprising:

generating a signal representing the volume rate of air through said exhaust fan;

generating a signal representing the temperature of the air through said exhaust fan; and calculating the weight rate of inlet air from said exhaust air volume and temperature signals.

11. The method of claim 8 including the step of adding a signal representing desired excess of exhaust air over inlet air to the signal representing the weight rate of exhaust air.

12. The method of claim 8 wherein the signal representing the exhaust air temperature is a preselected constant, and the volume rate of air exhausted by the exhaust fan is set at a preselected constant value.

* * * * *